US008485259B2

(12) United States Patent
Sponchia et al.

(10) Patent No.: US 8,485,259 B2
(45) Date of Patent: Jul. 16, 2013

(54) STRUCTURALLY STAND-ALONE FRAC LINER SYSTEM AND METHOD OF USE THEREOF

(75) Inventors: Barton Sponchia, Cypress, TX (US); Craig Skeates, Calgary (CA); Gary Gill, Calgary (CA); Abbas Mahdi, Calgary (CA)

(73) Assignee: Schlumberger Technology Corporation, Sugar Land, TX (US)

( * ) Notice: Subject to any disclaimer, the term of this patent is extended or adjusted under 35 U.S.C. 154(b) by 65 days.

(21) Appl. No.: 12/838,203

(22) Filed: Jul. 16, 2010

(65) Prior Publication Data

US 2011/0114320 A1 May 19, 2011

Related U.S. Application Data

(63) Continuation-in-part of application No. 12/685,513, filed on Jan. 11, 2010, now Pat. No. 8,220,547.

(60) Provisional application No. 61/230,337, filed on Jul. 31, 2009, provisional application No. 61/213,949, filed on Jul. 31, 2009.

(51) Int. Cl.
*E21B 43/26* (2006.01)
*E21B 33/068* (2006.01)

(52) U.S. Cl.
CPC ..... *E21B 43/26* (2013.01); *E21B 33/068* (2013.01)
USPC ..... 166/308.1; 166/308.2; 166/177.5; 166/313

(58) Field of Classification Search
USPC ..... 166/308.1, 308.2, 177.5, 313, 271
See application file for complete search history.

(56) References Cited

U.S. PATENT DOCUMENTS

| | | | | |
|---|---|---|---|---|
| 3,710,862 | A * | 1/1973 | Young et al. | 166/278 |
| 5,454,430 | A * | 10/1995 | Kennedy et al. | 166/50 |
| 5,526,880 | A * | 6/1996 | Jordan et al. | 166/291 |
| 6,446,727 | B1 | 9/2002 | Zemlak et al. | |
| 6,615,920 | B1 * | 9/2003 | Collins et al. | 166/313 |
| 7,021,384 | B2 | 4/2006 | Themig | |
| 7,353,878 | B2 | 4/2008 | Themig | |
| 7,441,604 | B2 | 10/2008 | Green | |

(Continued)

FOREIGN PATENT DOCUMENTS

WO 2009009445 A2 1/2009

OTHER PUBLICATIONS

European Search Report issued in EP10251348.8 on Apr. 7, 2011, 6 pages.

*Primary Examiner* — Cathleen Hutchins
(74) *Attorney, Agent, or Firm* — Brandon S. Clark

(57) ABSTRACT

A stand-alone frac liner that allows for fracturing of multiple lateral legs of a multilateral well on a single call out and rig-up of fracturing equipment. Tools and techniques are provided that include setting multiple stand-alone frac liners in multiple lateral legs of the multilateral well. The liners may rest in the legs physically untethered to surface equipment. Thus, a single call out of a frac string tubular and associated equipment may be used to frac the lateral legs in sequence from one leg to the next. This may be achieved without the requirement of removal of the tubular from the well or disconnect of surface fracturing equipment between the lateral fracture applications. Thus, a considerable amount of expenses associated with time and manpower may be saved.

15 Claims, 7 Drawing Sheets

U.S. PATENT DOCUMENTS

2003/0051876 A1 3/2003 Tolman et al.
2003/0221843 A1 12/2003 Fipke et al.
2006/0207763 A1* 9/2006 Hofman ..... 166/281
2007/0158073 A1 7/2007 Green

* cited by examiner

STRUCTURALLY STAND-ALONE FRAC LINER SYSTEM AND METHOD OF USE THEREOF

PRIORITY CLAIM/CROSS REFERENCE TO RELATED APPLICATION(S)

This Patent Document claims priority under 35 U.S.C. §119 to U.S. Provisional App. Ser. No. 61/230,337, filed on Jul. 31, 2009, entitled "Multilateral Selective Fracturing". This Patent Document is also a continuation-in-part claiming priority under 35 U.S.C. §120 to U.S. application Ser. No. 12/685,513, filed on Jan. 11, 2010, now U.S. Pat. No. 8,220,547 entitled "Method and Apparatus for Multilateral Multi-stage Stimulation of a Well", which in turn claims priority to U.S. Provisional App. Ser. No. 61/213,949 filed Jul. 31, 2009 of the same title, all of these patent documents being incorporated herein by reference in their entireties.

FIELD

Embodiments described relate to a system for fracturing multiple lateral legs of a conventional multilateral well. In particular, tools and techniques are described that allow for the placement of multiple stand-alone frac liners in multiple lateral legs. Thus, subsequent fracturing of each leg may take place without requiring intervening removal of fracturing surface equipment.

BACKGROUND

Exploring, drilling and completing hydrocarbon and other wells are generally complicated, time consuming and ultimately very expensive endeavors. In recognition of these expenses, added emphasis has been placed on efficiencies associated with well completions and maintenance over the life of the well. Over the years, ever increasing well depths and sophisticated architecture have made reductions in time and effort spent in completions and maintenance operations of even greater focus.

In terms of architecture, the terminal end of a cased well often extends into an open-hole lateral leg section. Additionally, such open-hole lateral legs are often found extending from other regions of the main vertical well bore. Such architecture may enhance access to the reservoir, for example, where the reservoir is substantially compartmentalized. Regardless, such open-hole lateral leg sections often present their own particular challenges when it comes to their completions and maintenance.

Fracturing applications, generally during well completion, constitute one area where significant amounts of time and effort are spent, particularly as increases in well depths and sophisticated architecture are encountered. Indeed, where a host of lateral legs are present as described above, a considerable amount of time and effort may be spent dedicated to fracturing of each individual leg. Once more, as described below, this expenditure of time and effort may be exacerbated by the particular sequential procedures that are required as a result of conventionally available frac equipment.

Fracturing of a lateral leg involves positioning surface fracturing equipment at the oilfield and hooking it up to the well. A frac string tubular terminating in a liner for positioning in the lateral leg may then be advanced to the leg for the fracturing application. Additionally, depending on the technique for directing the liner to the leg, a deflector may be prepositioned in the main bore of the well for such guidance. Further, once the fracturing application takes place through the liner, the frac string tubular may be removed and the well tested, with focus on flow of the fractured lateral leg. Subsequently, the surface fracturing equipment may be reset, the frac string tubular outfitted with another frac liner, and the process repeated at another lateral leg.

Overall, each leg of a multilateral well may be effectively fractured according to techniques such as those described above. However, the amount of time and effort spent on setting and re-setting surface fracturing equipment is quite significant. For example, once the initial fracturing takes place in the first lateral leg, subsequent testing, potential clean-out and other treatment of the leg closely follows. This requires the removal and replacement of the large fracturing equipment coupled to the well at the oilfield surface. Additionally, with the follow-on testing and potential treatment of the lined lateral leg, it is unlikely that a subsequent fracturing of another leg will take place in less than a few weeks.

It is not uncommon for the architecture of today's multilateral wells to include five or more lateral legs branching from the main bore. According to techniques described above, for each leg to be fractured, this would include positioning a deflector downhole, setting massive fracturing equipment, running a fracturing application, removing fracturing equipment and testing and/or treating the well and leg. Even this leaves out fracturing of the main bore and assumes that each lateral leg is pre-drilled before fracturing is begun, which generally is not going to be the case. Thus, as a practical matter, complete fracturing of a multi-lateral well is likely to take several months as well as countless man hours in numerous rig-ups and replacements of surface fracturing equipment.

SUMMARY

A method is described of utilizing multiple or "stacked" stand-alone frac liners in lateral legs off a main well bore. The method includes setting first and second stand-alone frac liners in first and second lateral legs. Frac equipment may then be employed for directing a fracturing application through one of the liners.

Additionally, a frac string tubular may be coupled to the one of the liners for the fracturing application. This tubular may be kept in the well and coupled to the other liner. Thus, a subsequent fracturing application may be performed through this other liner.

DETAILED DESCRIPTION

Embodiments are described with reference to certain multilateral well architectures and multi-frac sequential operations. For example, embodiments herein are detailed with reference to a particular tri-lateral well architecture. Additionally, lateral legs of the well are outfitted with frac liners and subsequent expansion joints in particular sequences described below. However, fracturing of multilateral wells according to embodiments described herein may be applied to a variety of different well architectures. Further, the particular sequence of positioning the system may vary. For example, in one embodiment, expansion joints and frac liners may be positioned simultaneously as opposed to sequentially. Regardless, embodiments described herein include a system of stand-alone frac liners for a multilateral well that allows fracturing at one lateral leg to be followed by fracturing at another without the requirement of intervening frac equipment removal, particularly at surface.

Figure 1:
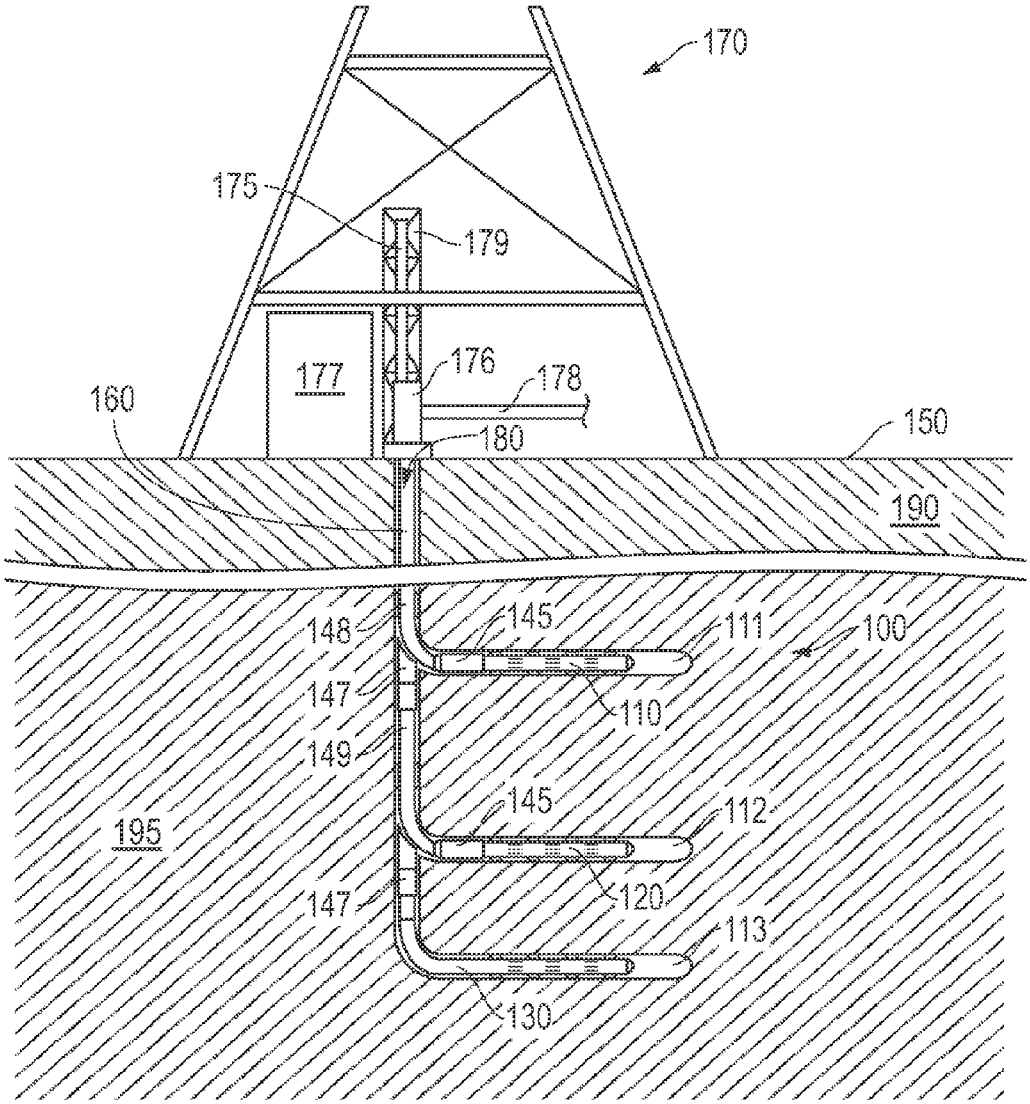
FIG. 1 is an overview of an oilfield with a multi-frac liner system installed in multiple lateral legs of a well through a formation.

Referring now to FIG. 1, an overview of an oilfield 150 is shown with a multi-frac liner system 100 installed in a well 180. More specifically, the system 100 includes several frac liners 110, 120, 130 positioned within multiple lateral legs 111, 112, 113 of the well 180. The well 180 traverses various formation layers 190, 195. However, the multiple lateral legs 111, 112, 113 are directed at a particular production layer 195, for example, where a compartmentalized reservoir may be targeted.

A rig 170 is positioned over a well head 176 at the surface of the oilfield 150 where a variety of surface equipment may be located for various applications to the well 180. In the embodiment shown, drill pipe 175 and support structure 179 are depicted as part of initial operations in positioning the multi-frac liner system 100 shown. An engine 177 for powering downhole placement is also shown. Perhaps more significantly however, now that the placement and positioning of the system 100 is complete, a fracturing line 178 is shown coupled to the well head 176 for fracturing as detailed in FIGS. 3A-3E below. This line 178 may in turn be coupled to a manifold and various frac pumps for generating high pressure for such fracturing.

The high pressure line 178 and other fracturing surface equipment may remain in place between fractures of different lateral legs 111, 112, 113 due to the nature of stand-alone frac liners 120, 130 of the system 100. That is, as shown, the uphole frac liner 110 may be coupled to a frac string tubular 160 running to surface. In the embodiment shown, this is achieved through an uphole expansion joint 148 which accommodates a running tool 145 at its end. However, as shown, the central 120 and downhole 130 frac liners are even more visibly stand-alone in nature. That is, upon installation, the liners 120, 130 are positioned in their respective lateral legs 112, 113 without maintaining physical communication with the surface. Thus, as detailed below, running tools 145 may be successively decoupled from liners 110, 120 and used to couple to deflectors 147 therebelow for sequential fracturing of the legs 111, 112, 113.

Figure 2A:
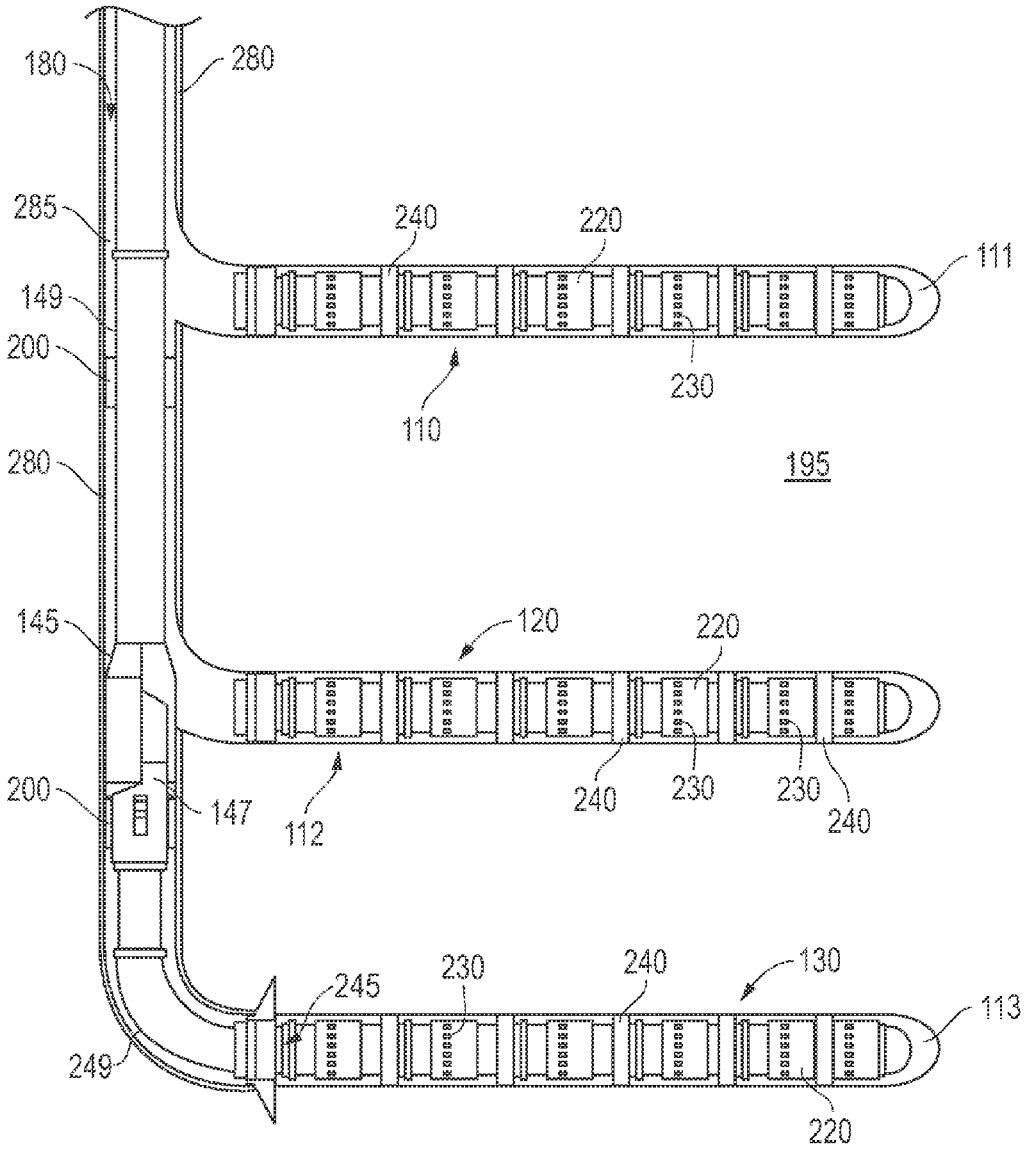
FIG. 2A is an enlarged view of the well and formation of FIG. 1 revealing the installation of a downhole expansion joint at a downhole liner of the system.
Figure 2B:
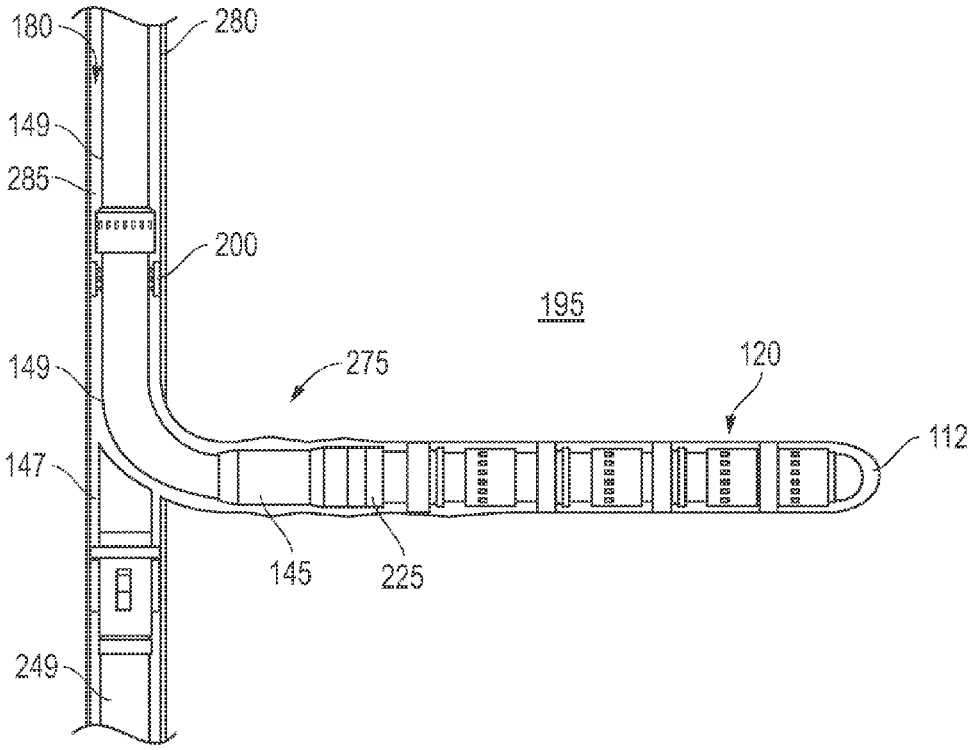
FIG. 2B is an enlarged view of a deflector of the expansion joint of FIG. 2A at a junction of the main bore and a lateral leg of the well for aiding installation of a central expansion joint.

A wide array of options are available for installation of the system 100 as shown in FIGS. 1 and 2A. For example, a main bore 285 of the well 180 may be drilled according to conventional techniques and terminating in a downhole lateral leg 113. A casing 280, various index couplings 200 and other features may subsequently be provided as depicted in FIGS. 2A & 2B. However, the downhole lateral leg 113 may remain primarily open-hole in nature. The liner 130 for this leg 113 may be installed via conventional techniques even before the other legs 111, 112 are drilled. Subsequent whipstock placement at index couplings 200 may be used to guide drilling of these other legs 111, 112, followed by placement of the respective liners 120, 130, generally working from downhole up.

Continuing with reference to FIG. 2A, an enlarged view of the well 180 and formation 195 of FIG. 1 are shown. In this view, the installation of a downhole expansion joint 249 at the downhole liner 130 is depicted. For this particular liner 130, the joint 249 is coupled to the liner hanger 245, a conventional anchor mechanism generally available at the interface of downhole end of casing 280 and a downhole liner 130. By the same token, the deflector 147 at the other end of this joint 249 may be delivered into position at the index coupling 200 by a running tool 145 of the central joint 148. Thus, as described below with regard to FIG. 2B, the tool 145 and joint 148 may subsequently be repositioned to allow delivery of the joint 148 to the central liner 120.

FIG. 2A also reveals features of the liners 110, 120, 130 in greater detail. Namely, the liners 110, 120, 130 are equipped with separate fracture housings 220. These housings 220 may include an internal sliding sleeve for internal exposure of the liners 110, 120, 130 to the legs 111, 112, 113 through orifices 230. Such exposure may be employed during fracturing and production as described further herein. Nevertheless, a given zone occupied by a given housing 220 may be isolated by conventional packers 240.

Referring now to FIG. 2B, an enlarged view of a junction 275 of the main bore 285 and the central lateral leg 112 of the well 180 is depicted. In this view, the deflector 147 of the downhole expansion joint 249 of FIG. 2A is shown with the running tool 145 of the central joint 149 disengaged therefrom. Rather, as described further below, the tool 145 is repositioned about a latch coupling 225 at the uphole end of the central frac liner 120.

As indicated above and with added reference to FIG. 1, the downhole expansion joint 249 is placed followed by placement of the central expansion joint 149. While a variety of techniques may be employed, in the embodiments described, all of the joints 148, 149, 249 are initially positioned in the main bore 285 of the well 180 linked to one another as a uniform assembly. Thus, following positioning of the most downhole joint (i.e. the downhole expansion joint, 249) as shown in FIG. 2A, the central joint 149 may be placed as depicted in FIG. 2B.

The above noted repositioning is achieved by rotatable decoupling of the central running tool 145 from the downhole deflector 147 as guided by the depicted index coupling 200. That is, the vertically oriented uphole 148 and central 149 expansion joints may be rotated from the oilfield surface 150. Thus, the central running tool 145 may be rotatably disengaged from the downhole deflector 147 and its joint 249, due to its vertical positioning (see FIG. 2A). As this takes place, the index coupling 200 may be employed to provide orientation information regarding the tool 145 in conjunction with its decoupling from the deflector 147. Once more, the changed orientation of the tool 145 which allows for the decoupling also allows for its deflection into the central leg 112. That is, the deflector 147 is configured such that reinsertion of the newly oriented tool 145 and central joint 149 lead to deflection thereof into the central leg 112 as shown. Indeed, this process may be repeated for placement of the uphole joint 148, ultimately resulting in the stacked multilateral frac liner system 100 apparent in FIG. 1.

Referring now to FIGS. 3A-3E one embodiment of sequentially fracturing multiple lateral legs 111, 112, 113 with the fully installed stacked frac liner system 100 is described. Perhaps most notably, the prepositioning of stand-alone liners 110, 120, 130 in advance of fracturing, allows for operations to take place without removal of the frac string tubular 160 or fracture line 178 and equipment replacement between separate leg fractures (see FIG. 1). Thus, a fair amount of time and a substantial amount of manpower and expense may be saved.

Figure 3C:
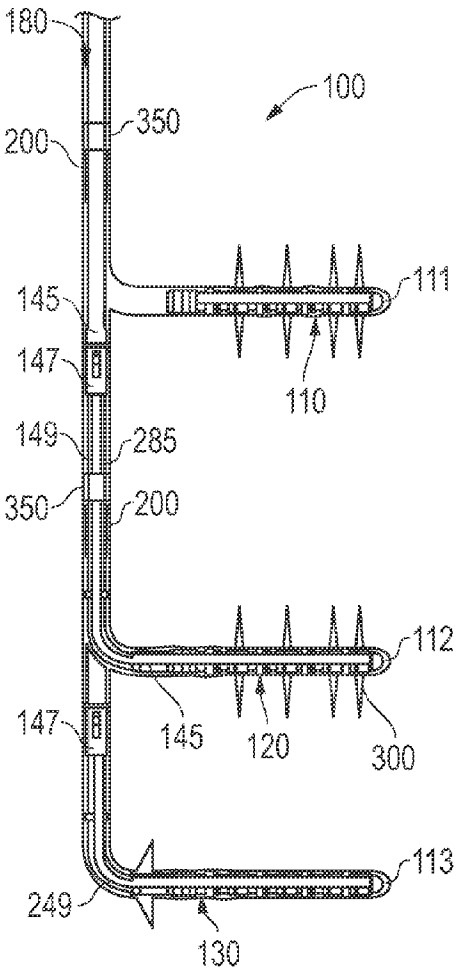
FIG. 3C is a side view of the system of FIG. 3B with the running tool of the uphole expansion joint engaged with the deflector of the central expansion joint for fracturing of the central lateral leg through the central liner.
Figure 3B:
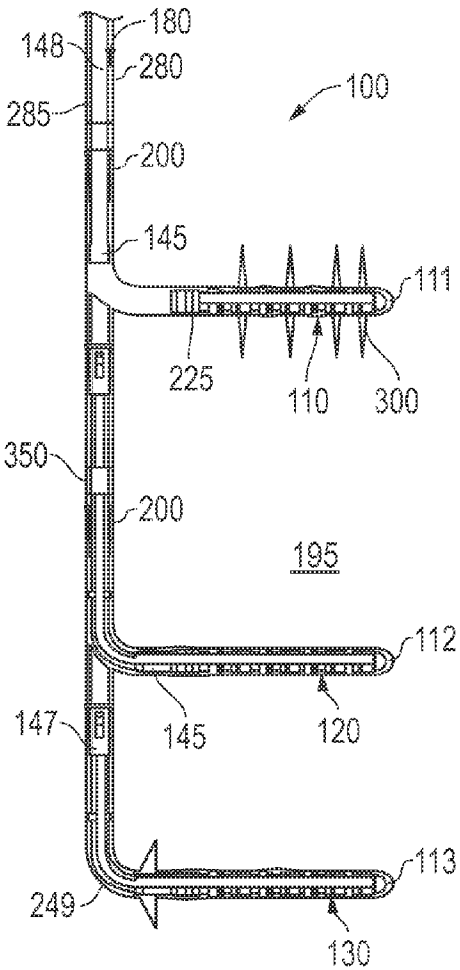
FIG. 3B is a side view of the system of FIG. 3A, with a running tool of an uphole expansion joint disengaged from the uphole liner and drawn into the main bore.
Figure 3A:
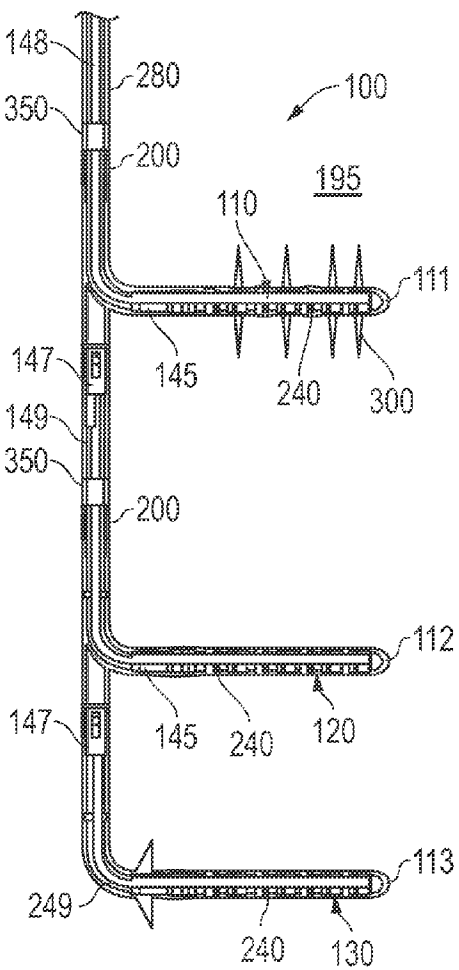
FIG. 3A is a side view of the installed system of FIG. 1, with a fracturing application applied to an uphole lateral leg through an uphole liner.

With particular reference to FIG. 3A, a side view of the installed system 100 is depicted as described above. This view is similar to that of FIG. 1. However, in this depiction, fractures 300 are shown at the uphole leg 111. That is, with added reference to FIG. 1, the frac string tubular 160 is in direct communication with the uphole lateral leg 111 upon installation of the entire system 100. Thus, a fracturing application may take place through the tubular 160, uphole extension joint 148 and liner 110. This fracturing may take place via conventional techniques with internal sliding sleeves and seals 240 of the liner 110 guiding fracturing into the formation 195 and isolation in terms of flow.

Similarly, in an alternate embodiment fracturing of the main bore 285 may precede fracturing of the uphole leg 111. For example, each expansion joint 148, 149, 249 may be outfitted with a ported fracture housing 350. Further, isolation may be provided by the innermost seals 240 of the liners 110, 120, 130 and conventional sealing above the housing 350. Thus, adjacent sliding sleeves or perforations in the casing 280 may allow for effective vertical fracturing of the main bore 285 in advance of the uphole lateral leg 111.

Once fracturing has taken place as depicted in FIG. 3A, a small amount of recovery and/or production may take place directly through the liner 110 and uphole joint 148. Additionally, an additional conventional internal seal may be provided near the latch coupling 225 to isolate the uphole leg 111 until later production operations (see FIG. 3B).

Referring now to FIG. 3B, a side view of the system 100 of FIG. 3A is depicted. However, in this view, a running tool 145 of the uphole expansion joint 148 is shown disengaged from the uphole liner 110 and drawn into the main bore 285 of the well 180. As detailed above regarding installation of the joints 148, 149, 249, the manner of tool disengagement may be a matter of rotation as guided by and accounted for by the index coupling 200 associated with the uphole expansion joint 148 and running tool 145.

Moving directly to FIG. 3C, a side view of the system 100 of FIG. 3B is shown with the uphole running tool 145 now engaged with the central deflector 147 of the central expansion joint 149. Thus, fracturing of the central lateral leg 112 through the central liner 120 is also depicted. The orientation and locking of the tool 145 at the deflector 147 may proceed with the guidance of the appropriate index coupling 200 as detailed above. Additionally, as also detailed above, fracturing of the main bore 285, in this case through the ported fracture housing 350 of the central expansion joint 149, may precede the central leg 112 fracturing as depicted.

Once fracturing has taken place as depicted in FIG. 3C, a small amount of recovery and/or production may again take place directly through the liner 120 and central joint 148. Further, an additional conventional internal seal may be provided near the latch coupling 225 to isolate the central leg 112 until later production operations (see FIG. 3D).

Figure 3E:
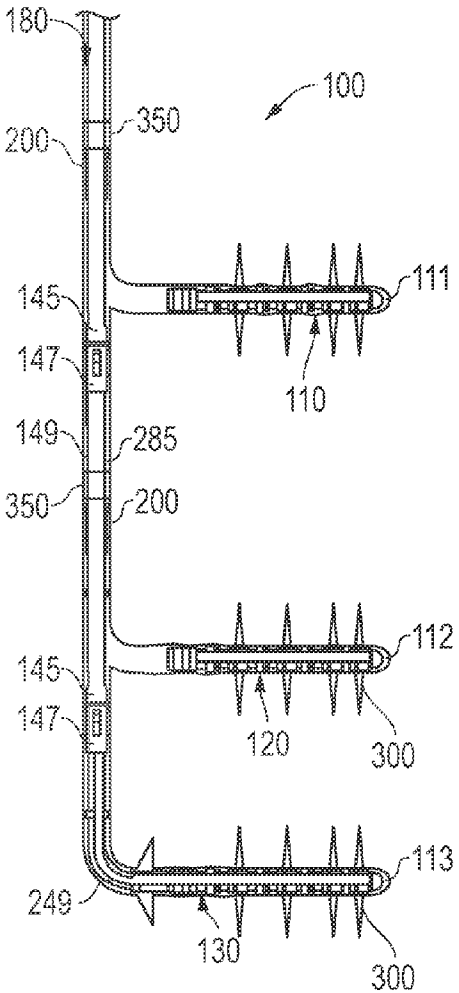
FIG. 3E is a side view of the system of FIG. 3D with the running tool of the central expansion joint engaged with the deflector of the downhole expansion joint for fracturing of the downhole lateral leg through the downhole liner.
Figure 3D:
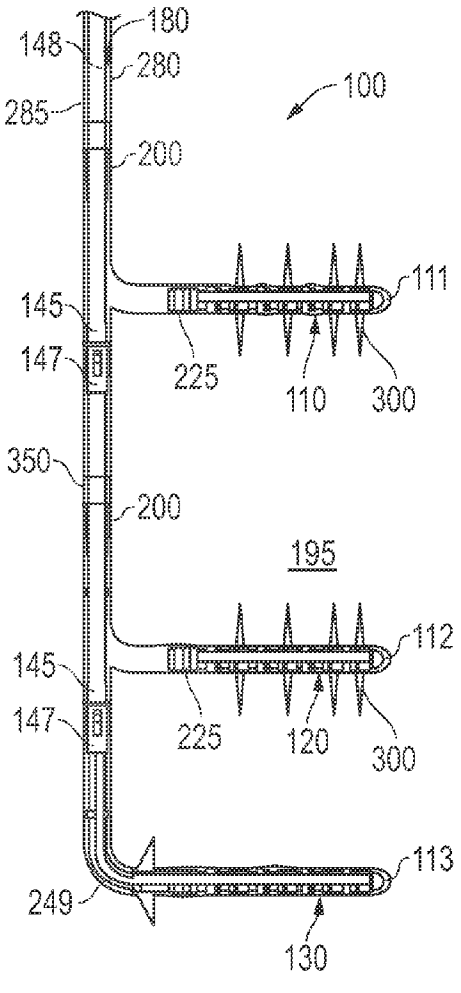
FIG. 3D is a side view of the system of FIG. 3C with a running tool of the central expansion joint disengaged from the uphole liner and drawn into the main bore.

Referring now to FIG. 3D, the steps of moving to the next downhole leg for fracturing are repeated. That is, in this depiction the running tool 145 of the central expansion joint 149 is shown disengaged from the central liner 120 and drawn into the main bore 285 of the well 180. Again, the manner of tool disengagement may be a matter of rotation as guided by and accounted for by the relevant index coupling 200 associated with the central expansion joint 149 and running tool 145.

Moving now to FIG. 3E, the system 100 of FIG. 3B is shown with the central running tool 145 now engaged with the downhole deflector 147 of the downhole expansion joint 249. Thus, fracturing of the downhole lateral leg 113 through the downhole liner 130 is also depicted. The orientation and locking of the tool 145 at the deflector 147 may again proceed with the guidance of the appropriate index coupling 200 as detailed above. Additionally, note that in the embodiment of FIG. 3E, due to the architecture of the terminal end of the main bore 285 the downhole expansion joint 249 is not outfitted a ported fracture housing. However, in alternate embodiments, particularly where this portion of the bore 285 and/or the joint 249 cover greater distances, a ported fracture housing may be provided for fracturing above and in advance of the downhole leg 113.

Figure 4:
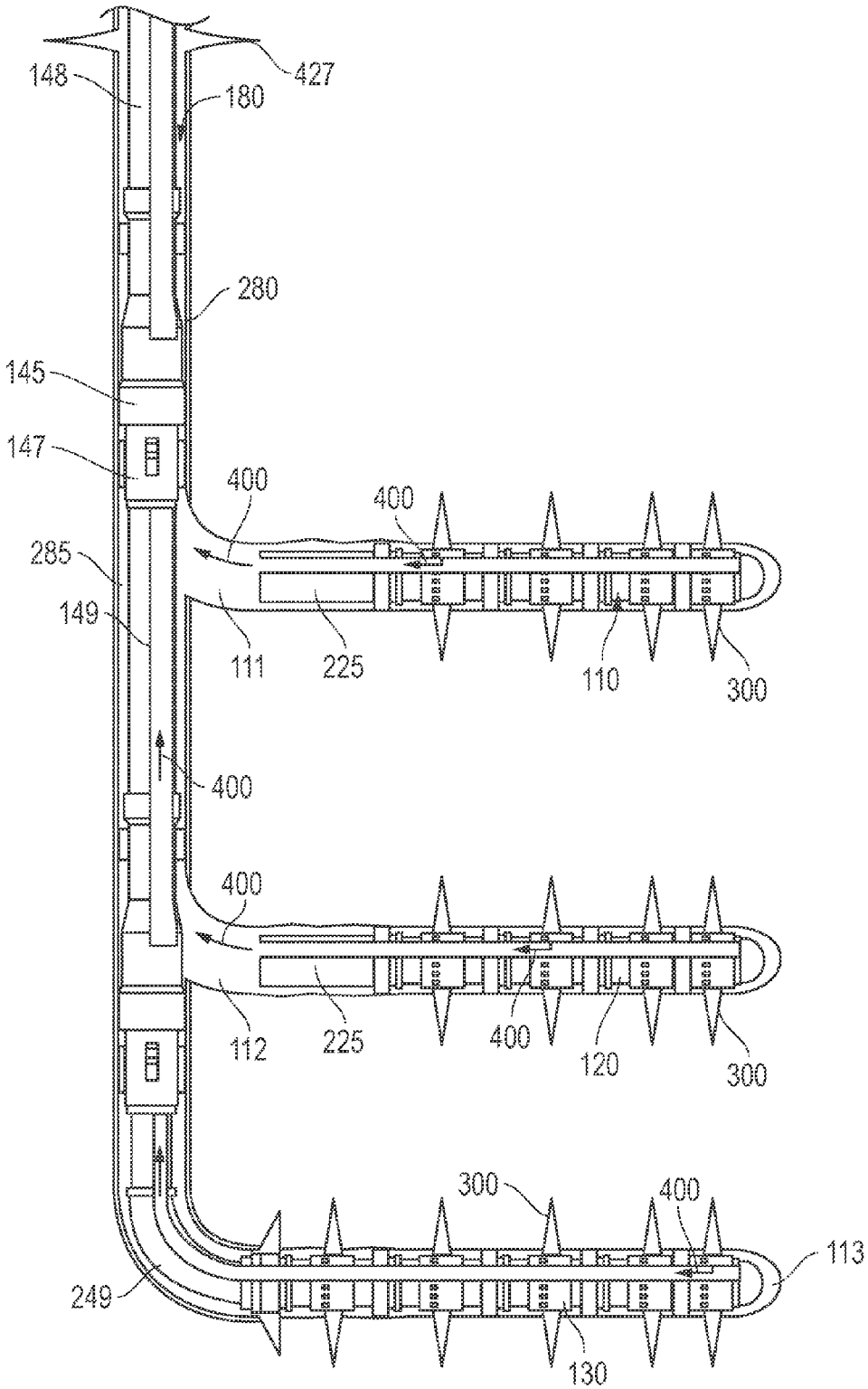
FIG. 4 is a side cross-sectional view of the system of FIG. 3E revealing a flow of produced hydrocarbons therethrough.

Referring now to FIG. 4, a side cross-sectional view of the system 100 of FIG. 3E is shown following fracturing of each lateral leg 111, 112, 113 as detailed above. Additionally, in this view, prior uphole fracturing of the main bore is evident of at perforation 427. Further, a flow 400 of produced hydrocarbons is shown emanating from each leg 111, 112, 113 and through the system 100. More specifically, a flow 400 from the downhole liner 130 is depicted interior of the downhole joint 249 whereas the flow 400 from the uphole 110 and central 120 liners openly empties into the main bore 285 for uphole travel.

In closing out fracturing operations, such production and flow as depicted in FIG. 4 may be utilized to ensure the effectiveness of the stacked multi-lateral fracturing that has taken place on a single call out of fracturing equipment. That is, a flow back of all of the lateral legs 111, 12, 113 may take place simultaneously. Thus, the amount of time spent testing in advance of production may be substantially reduced.

In the embodiment of FIG. 4, the uphole 110 and central 120 liners are left interiorly unsealed at their respective latch couplings 225. Furthermore, production is taking place through the fracturing equipment, including expansion joints 148, 149, 249, running tools 145 and deflectors 147. Thus, while production may continue through the system 100 as depicted, in alternate embodiments, the fracturing equipment in the well 180 may be replaced with more conventional production equipment as described below.

In one embodiment, the joints 148, 149, 249 may be replaced with production tubing coupled to the downhole liner 130 and equipped with sliding sleeves for communication with the uphole 110 and central 120 liners. Alternatively, the production tubing may be terminally anchored by a packer positioned above the lateral legs 111, 112, 113 and open to the main bore 285 as are each of the liners 110, 120, 130. Thus, flow 400 may openly proceed uphole from each of the liners 110, 120, 130 through the main bore 285 and into the production tubing. In yet another embodiment, thru tubing may be provided between each of the liners 110, 120, 130 and production tubing in the main bore 285. Thus, discrete and direct flow 400 may take place between each liner 110, 120, 130 and production tubing.

Figure 5:
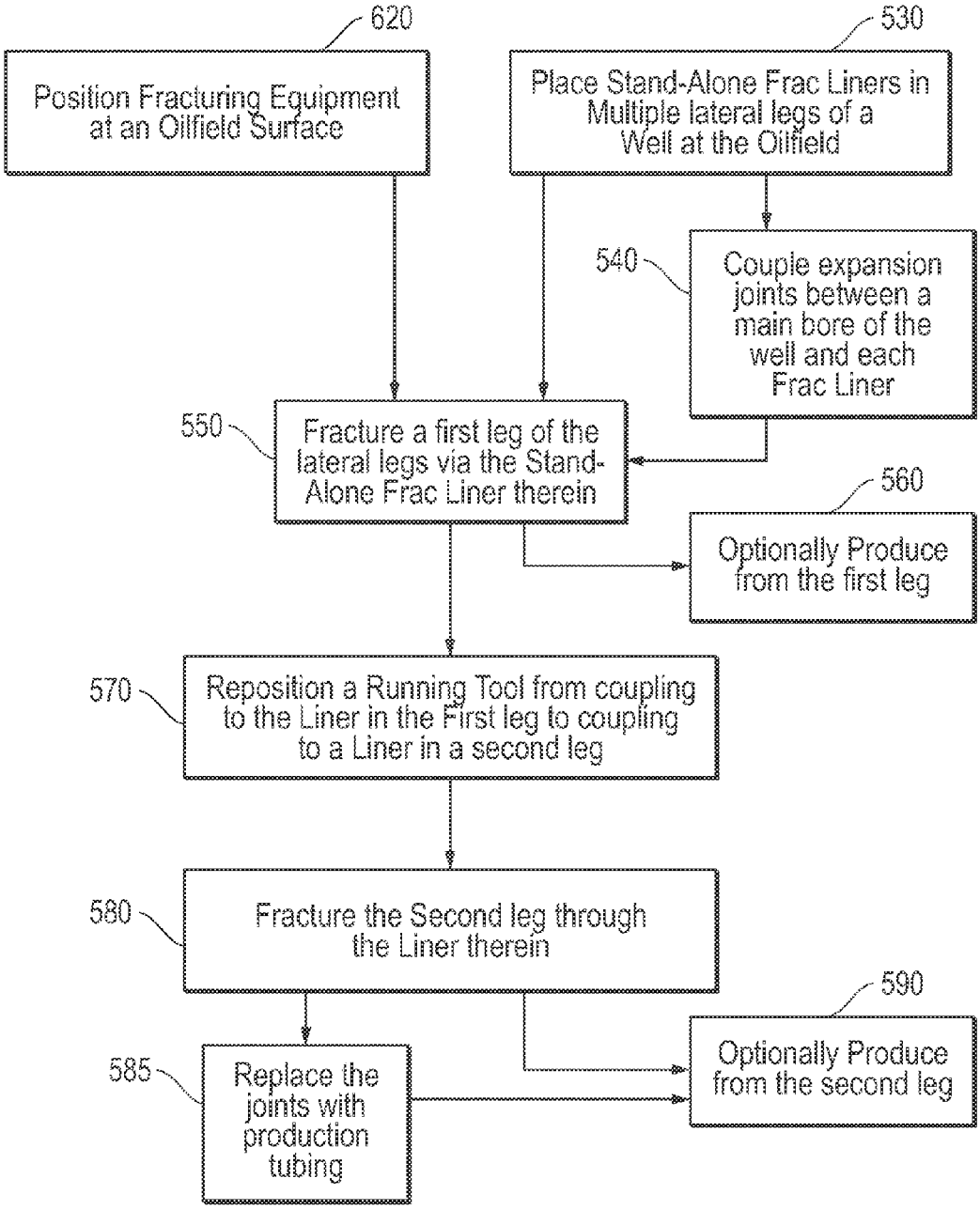
FIG. 5 is a flow chart summarizing an embodiment of employing a multi-frac liner system in a multi-lateral well.

Referring now to FIG. 5, a flow chart summarizing an embodiment of employing a multi-frac liner system in a multi-lateral well is shown. In the embodiment shown, a single call out of fracturing equipment may take place as indicated at 520 even though multiple lateral legs of a well are to be fractured. As indicated at 530, this efficiency is afforded by the placement of stand-alone frac liners in multiple lateral legs of the well. This may include the placement of expansion joints between these liners and the main bore of the well. Alternatively, as indicated at 540, the expansion joints may be separately provided.

Continuing with reference to FIG. 5, with the system in place, one of the legs may be fractured via its structurally stand-alone frac liner as indicated at 550. In one embodiment, hydrocarbons may initially be produced from this leg (see 560). As noted at 570, following this initial fracturing, a running tool that is in communication with the oilfield surface may be repositioned from coupling to the liner in the first leg to coupling to a liner in a second leg. Thus, as shown at 580, the second leg may be fractured via the liner therein. Notably, this takes place without the requirement of intervening positioning and re-positioning of fracturing equipment at the oilfield surface. Though, if desired, the tubular joints and overall frac string may be removed to surface for replacement with more conventional production tubing as alluded to above (see 585). Further, as indicated at 590, hydrocarbons may be produced from this second leg, for example as a test of fracturing effectiveness, even in advance of production tubing placement.

Embodiments described hereinabove provide tools and techniques for fracturing of multilateral wells without the requirement of positioning and repositioning massive fracturing equipment at the oilfield surface. Rather, through the use of a stacked and prepositioned, stand-alone frac liner system, a lateral fracturing application may be followed by brief production, testing and hookup for a successive lateral fracture without the requirement of fracturing equipment removal.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. For example, a variety of production tubing architectures may be employed as described above. Additionally, stand-alone liners may be cemented in place or take a variety of other configurations in addition to those detailed hereinabove. Furthermore, the foregoing description should not be read as pertaining only to the precise structures described and shown in the accompanying drawings, but rather should be read as consistent with and as support for the following claims, which are to have their fullest and fairest scope.

We claim:

1. A method comprising:

setting a first structurally stand-alone frac liner in a first lateral leg of a well through a formation;

setting a second stand-alone frac liner in a second lateral leg of the well, the second lateral leg located uphole of the first lateral leg; and employing frac equipment at an oilfield surface adjacent the well to direct a fracturing application through the liners after both of said settings, the fracturing directed through the second liner sequentially in advance of the first liner.

2. The method of claim 1 further comprising fracturing a main bore of the well prior to said employing.

3. The method of claim 1 further comprising recovering a downhole fluid from the formation through the one of the liners.

4. The method of claim 1 wherein said employing comprises coupling a frac string tubular in the well to the one of the liners for the fracturing application.

5. The method of claim 4 further comprising:

maintaining the tubular in the well for coupling thereof to a third stand-alone frac ling in a third lateral leg of the well; and fracturing the third leg.

6. The method of claim 4 wherein said keeping comprises:

disengaging a running tool of the tubular from the one of the liners; and engaging the tool with a deflector coupled to the other frac liner prior to said performing.

7. The method of claim 6 wherein said disengaging and said engaging are aided by an index coupling incorporated into a main bore of the well adjacent the lateral legs.

8. A method of completing a multilateral well, the method comprising:

forming a main bore of the well and a lateral leg termination thereof;

positioning a downhole structurally stand-alone frac liner in the lateral leg termination;

drilling another lateral leg uphole of the lateral leg termination;

placing an uphole stand-alone frac liner in the uphole lateral leg;

coupling a downhole expansion joint in the main bore to the downhole liner;

coupling an uphole expansion joint in the main bore to the uphole liner;

fracturing the uphole leg through a frac string tubular coupled to the uphole joint;

keeping the tubular in the main bore;

coupling the tubular and the uphole joint to the downhole joint; and fracturing the lateral leg termination after said fracturing of the uphole leg.

9. The method of claim 8 further comprising casing the main bore of the well prior to said drilling.

10. A stand-alone frac liner system comprising:

a first stand-alone frac liner for positioning in a first lateral leg of a well;

a second stand-alone frac liner for positioning entirely within a second lateral leg of the well; and a frac string tubular for keeping in a main bore of the well and alternatingly coupling to either of said liners via different connecting joints thereof for fracturing of either of the legs.

11. The stand-alone frac liner system of claim 10 wherein the different connecting joints further comprise:

a first expansion joint disposed in the main bore and coupled to said first liner; and a second expansion joint disposed in the main bore and coupled to said second liner, the coupling of the tubular to either of said liners via said joints.

12. The stand-alone frac liner system of claim 10 further comprising:

a casing defining said main bore; and a ported fracture housing incorporated into one of said tubular and said liners for fracturing of the main bore through said casing.

13. A structurally stand-alone frac liner for positioning entirely within one of multiple lateral legs of a multilateral well through a formation, the liner comprising:

a plurality of frac housings with orifices for communication with the formation; and a plurality of packers for isolation of each of the housings, the liner configured for deployment in the one of the legs absent structural communication with surface equipment at an oilfield surface adjacent the well.

14. The stand-alone frac liner of claim 13 further comprising a latch coupling for alternating connection to a frac string tubular coupled to the surface equipment to fracture the one of the legs.

15. The stand-alone frac liner of claim 14 wherein the connection is attained via an expansion joint coupled to the latch coupling in the one of the legs and the tubular in a main bore adjacent the one of the legs.

* * * * *